United States Patent [19]

Fabbri

[11] 4,233,651

[45] Nov. 11, 1980

[54] WORK AREA LIGHTING SYSTEM

[75] Inventor: William C. Fabbri, Billerica, Mass.

[73] Assignee: Keene Corporation, New York, N.Y.

[21] Appl. No.: 891,697

[22] Filed: Mar. 30, 1978

[51] Int. Cl.[3] ..... F21V 5/02; F21V 11/18; F21V 13/04

[52] U.S. Cl. ..... 362/33; 362/127; 362/223; 362/260; 362/268; 362/290; 362/319; 362/330; 362/331

[58] Field of Search ..... 362/33, 127, 187, 222–224, 362/256, 260, 268, 277, 279, 281, 290, 330–331, 354, 359, 248, 280, 303, 319, 351, 217, 235, 244, 246, 307–309, 311; 313/117 X; 350/278, 283; 351/46–47

[56] References Cited

U.S. PATENT DOCUMENTS

| | | | |
|---|---|---|---|
| 3,972,593 | 8/1976 | Appledorn | 350/276 |
| 4,022,475 | 5/1977 | Todd | 351/46 |
| 4,054,793 | 10/1977 | Shemitz | 362/224 |
| 4,059,755 | 11/1977 | Brabson | 362/330 |

FOREIGN PATENT DOCUMENTS

| | | | |
|---|---|---|---|
| 414726 | 8/1934 | United Kingdom | 362/33 |

*Primary Examiner*—Charles T. Jordan
*Assistant Examiner*—Edward F. Miles
*Attorney, Agent, or Firm*—Kane, Dalsimer, Kane, Sullivan and Kurucz

[57] ABSTRACT

A work area lighting system is provided including a housing containing a linear light source therein and having an open bottom end. A refractor comprising a pair of refractor plate members closes the open bottom end. The refractor includes a first member having a plurality of spaced prisms extending parallel to the light source and a second member having a plurality of spaced prisms extending perpendicular to the light source. The second member underlies the first member and is approximately one-half its length. The second member is moveably mounted to the housing to enable it to slide with respect to the first member so that different portions of the first member may be covered as desired.

5 Claims, 7 Drawing Figures

WORK AREA LIGHTING SYSTEM

BACKGROUND OF THE INVENTION

The present invention relates to lighting systems and in particular to an improved lighting system for lighting a work area with reduced glare and veiling reflections.

In U.S. Pat. No. 4,054,793 issued Oct. 18, 1977 to Sylvan R. Shemitz there is disclosed a desk level work area lighting system. As set forth in that patent, the object of such systems is to provide lighting whereby direct glare and veiling reflections are substantially eliminated from a task positioned at the work area. For this reason such lighting systems are commonly referred to as "task" lighting. The Shemitz patent utilizes a light fixture positioned above the desk. Light from a linear source(i.e., such as an elongated fluorescent tube) is reflected through a refractor member having prisms extending perpendicular to the light source. The resultant distribution of luminous flux from the Shemitz system is illustrated in FIG. 3 of that patent which, for convenience, is reproduced as FIG. 1 of the present application. In order to reduce direct glare and veiling reflections on the desk top surface, the half bat wing configuration of luminous flux eminating from the fixture is directed to the right and left by the refractor member shown in FIG. 1.

The sacrifice paid for eliminating glare and veiling reflections from the center of the work area is decreased illumination at the extremes of the desk. That is, when a person is sitting at the center of the desk and looks to his right or left, those areas will appear abnormally dark. An actual measurement of foot candle distribution over the desk top surface (taken with a Weston Foot Candle meter, Model 756 which was visual and cosine corrected) for a lighting system utilizing the refractor of the Shemitz patent is set forth in FIG. 2. As can be seen, the available foot candles of light drops off drastically at the right and left ends of the desk as compared with the center of the desk and in fact are less than 60% of the foot candles available at the center of the desk. Thus, a worker whose work is spread over the entire desk would have difficulty seeing and working on a task positioned at the ends of his desk.

In view of the above, it is the principal object of the present invention to provide an improved lighting system for a desk level work station capable of providing reduced direct glare and veiling reflections to the work station, while providing substantially uniform light distribution over the entire work station.

A further object is to provide such a system which is sufficiently flexible to permit the light flux distribution to be varied as required over the desk top.

Further objects and advantages will become evident from the following Specification.

SUMMARY OF THE INVENTION

The above and other beneficial objects and advantages are attained in accordance with the present invention by providing an improved work area lighting system which comprises a housing system adapted to be positioned above a desk level work area. The housing contains therein an elongated linear light source and includes an open-bottom end. A refractor is mounted to the housing for refracting light produced by the source. The refractor comprises a pair of overlying plate members including a refractor plate top member having a plurality of spaced prisms extending parallel to the linear light source and a bottom refractor plate member having a plurality of spaced prisms extending perpendicular to the linear light source. The bottom member is approximately half the length of the top member and is mounted within the housing so as to be slidable with respect to the top member. The top member is substantially co-extensive in length with the light source.

DETAILED DESCRIPTION OF THE PREFERRED EMBODIMENT

Figure 3:
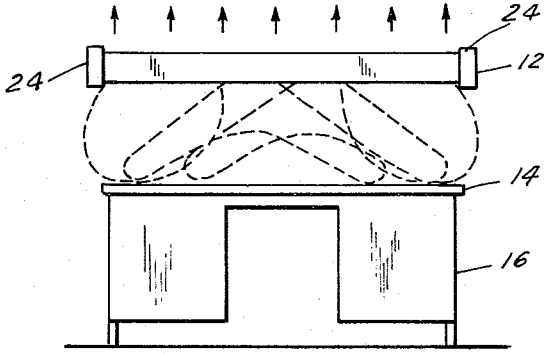
FIG. 3 is a view similar to FIG. 1, but utilizing a lighting fixture in accordance with the present invention.

Reference is now made to the drawings and to FIG. 3 in particular wherein a lighting system 10 in accordance with the present invention is depicted. The system comprises a housing 12 containing therein a pair of elongated fluorescent light tubes to illuminate the top surface 14 of a work station or a desk 16. The housing 12 is typically mounted above desk 16 in the range from above seated eye height to about standing eye height. The manner of mounting is discussed in detail in the previously mentioned U.S. Pat. No. 4,054,793. For the present is suffices to say that the mounting should be such as to not interfere with the vision of a worker seated or standing at the desk.

Figure 5:
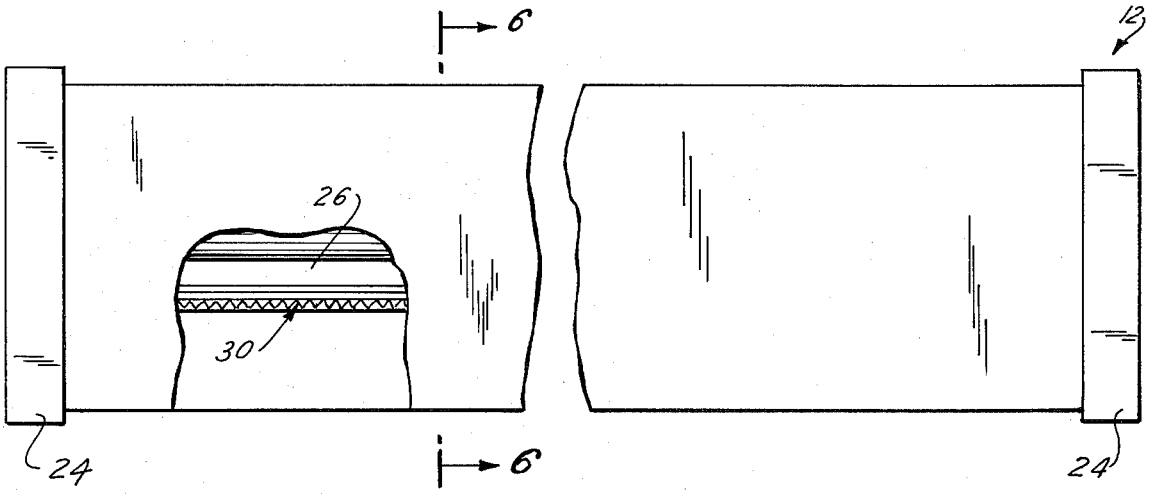
FIG. 5 is a partially fragmentary side elevational view of the lighting fixture of the present invention.
Figure 6:
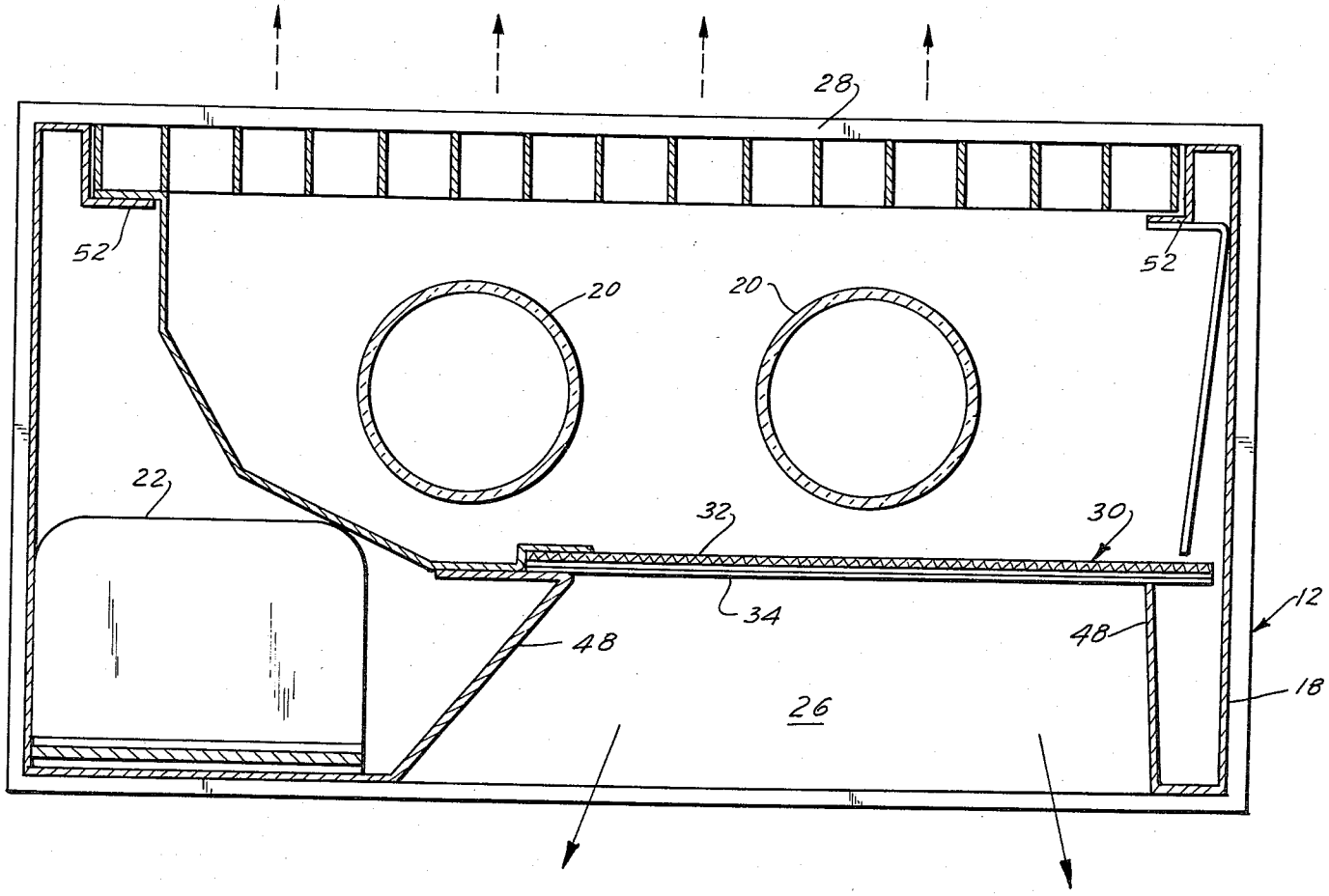
FIG. 6 is a sectional view taken along reference line 6—6 of FIG. 5 in the direction indicated by the arrows.

Referring to FIGS. 5 and 6 it can be seen that the housing 12 comprises a sheet metal frame 18 containing therein a pair of elongated florescent bulbs 20 along with the necessary associated ballast 22 and wiring (not shown). The ends of the housing are closed off by end caps 24 to provide a uniform and finished appearance.

Referring to FIG. 6, it can be seen that both the bottom 26 and top end 28 of the housing are open. This permits light flux to eminate upwardly and downwardly as will be described. The bottom end of the fixture is closed by a refractor assembly 30 (the details of which may be best seen in FIG. 7) which comprises a first refractor plate member 32 and a second refractor plate member 34. Both members 32 and 34 are formed from commercially available refractor plate sheet stock. The plates are formed of acrylic or other clear plastic and each has a top and bottom light eminating surface. Member 32 has a flat light incident surface 36 (i.e, directed toward the light source) and a light emergent surface 38 (i.e., directed away from the light source) formed with a plurality of longitudinally extended side by side prisms 40. Refractor plate member 32 is substantially co-extensive in length with the florescent tubes 26.

Figure 7:
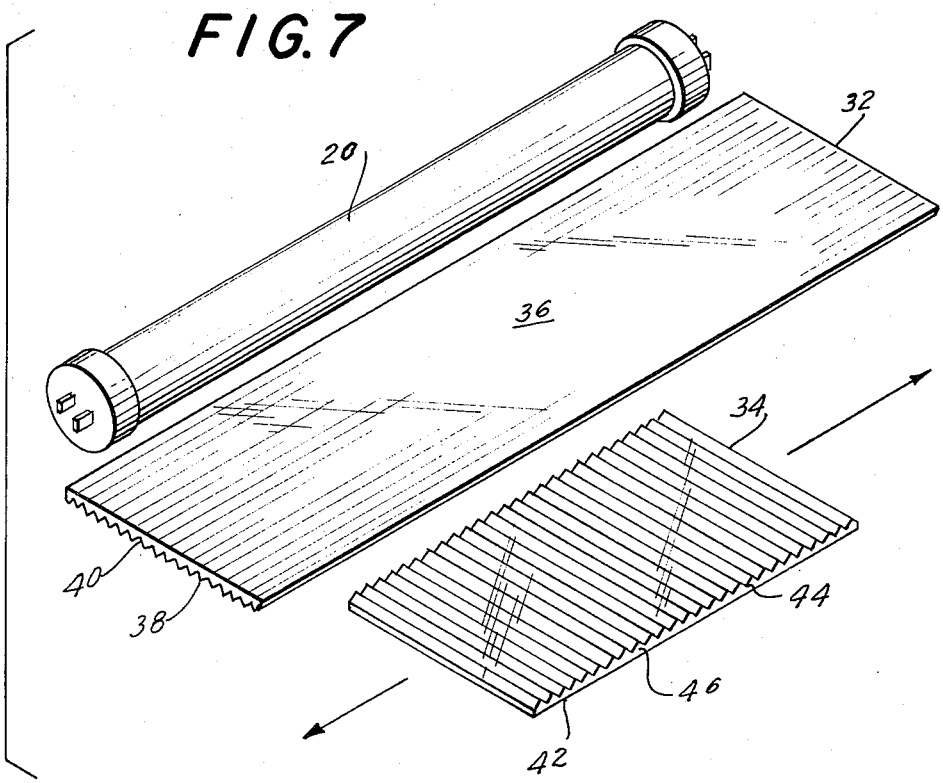
FIG. 7 is an exploded diagramatic perspective view showing the relative positioning of the linear light source, and refractor top and bottom plate along with the orientation of the prisms on the members.

The second refractor plate member 34 is approximately one-half the length of the first refractor plate member. It too is formed of plastic and has light incident and light emergent surfaces. The bottom surface 42 (i.e., the light emergent surface) of member 34 is flat. The top surface 44 (i.e., the light incident surface) of plate 34 contains thereon a series of side by side parallel prisms 46 oriented perpendicular to the light source. Thus, as shown in FIG. 7, the prism bearing surfaces of plates 32 and 34 face each other and the prisms of the two surfaces extend perpendicular to each other.

As pointed out above, the refractor plates members are formed from commercially available sheet stock. The prisms are designed to distribute light in a bat wing configuration which is a highly desirable light configuration. Such plates are available as "K-S-H 701 Lensmatic" produced by K-S-H, Inc., St. Louis, Missouri, as well as from other sources.

Referring to FIG. 6, it can be seen that the housing frame 18 is formed to define a track 48 extending along opposite sides of the fixture. The track supports the refractor members 32 and 34 in position, as shown below the light source. Both plates 32 and 34 ride freely on track 48. However, since plate 32 is substantially equal in length to the light source 20, it is captured in place by the end caps and thus prevented from sliding longitudinally. Refractor plate 34 is approximately half the length of plate 32 and thus it is free to slide along track 48 to assume any position along the track.

As was stated, the top end 28 of the frame is also open. An acrylic, open louver baffle is provided to close the open top end of the fixture and diffuse light eminating upwardly from the light sources. Frame 18 is formed to define a pair of opposed tracks 52 at the upper end of the housing extending longitudinally along both sides of the fixture which serve to support the baffle. The baffle may readily be removed to provide access to the bulbs for servicing and maintenance.

As stated, FIG. 3 depicts the light distribution pattern of the present lighting system as distributed over an associated desk 16. The light distribution pattern was obtained with the lower refractor 34 positioned under the center of the upper refractor member 32. Since refractor plate 34 is approximately one-half the length of refractor plate 32, approximately one-quarter the length of refractor 32 overhangs on each side of refractor 34. That is, the light passing through the extreme quarter sections of refractor member 32 is not further refracted by passing through member 34. As a result, the bottom refractor 34 only splits the light rays emitted only through the central half of the top refractor. Light eminating at the extremes is substantially undisturbed. The resultant light distribution is shown in FIG. 3. As can be seen, only the central bat wing configurations are broken up by the prisms of refractor 34. As a result, more light is available at the ends of the desk. While the light at the ends of the desk will not have the glare free properties of the light at the center of the desk, this is not undesirable since the light at the principal work area is glare free.

Figure 4:
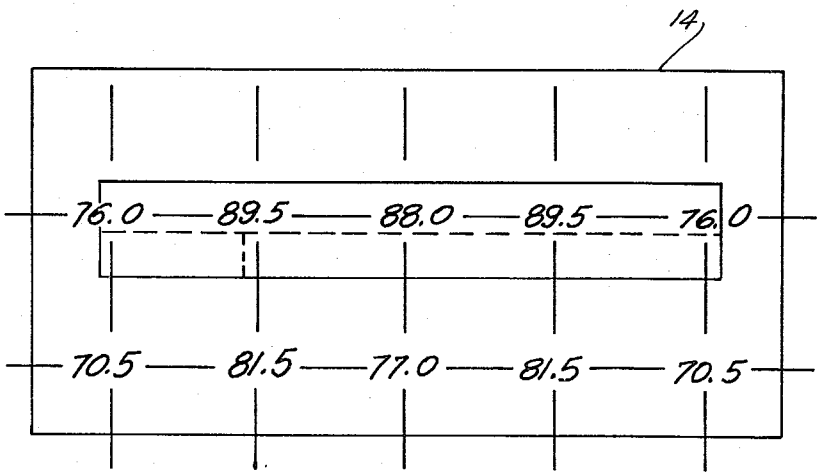
FIG. 4 is a view similar to FIG. 2 showing the foot candle lighting distribution of the fixture of FIG. 3.
Figure 1:
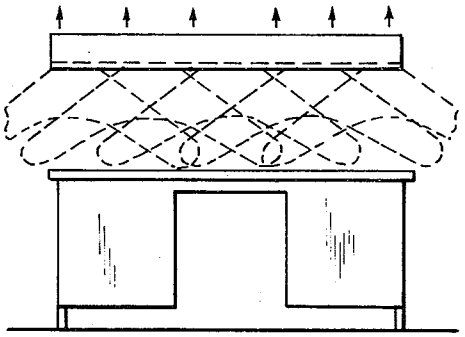
FIG. 1 PRIOR ART
FIG. 1 is a partly diagramatic, elevational view of a work station utilizing a lighting fixture as disclosed in U.S. Pat. No. 4,054,793 and is taken from FIG. 3 of that Patent.
Figure 2:
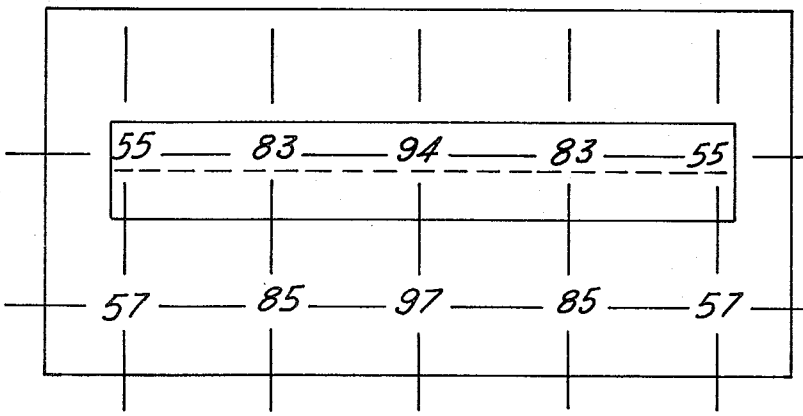
FIG. 2 PRIOR ART
FIG. 2 is a top plan view of the work station of FIG.1 showing the foot candle distribution of light over the work station top surface.

In a successful practice of the present invention, two F40T12/WW lamps 48" long were utilized as the linear light source. The top refractor plate 32 was 48" long and the bottom refractor plate 34 was 24" long. Readings over the desk top surface of the available light area taken in foot candles (with a Weston Foot Candle Meter, Model 756 visual and cosine corrected) and are set forth in FIG. 4. In comparison, the same fixture utilizing the refractor disclosed in U.S. Pat. No. 4,054,793 was used to obtain the data set forth in FIG. 2. Comparison of FIGS. 2 and 4 shows that light distribution over desk top 14 is substantially more uniform than that of FIG. 2. Further, by making refractor plate 34 shiftable, the principal glare free light may be directed over any desired portion of the desk top thereby permitting a worker to set the fixture as required for any particular task.

Thus, in accordance with the above, the aforementioned objectives are effectively obtained.

I claim:

1. A work area lighting system for providing a combination of substantially glare-free and non-glare-free light comprising: a housing positioned above said work area, said housing having an open bottom end; an elongated linear light source having a longitudinal axis mounted within said housing; a refractor comprising a pair of superimposed plate members mounted to said housing closing said open bottom end, said refractor having a first refractor plate member substantially co-extensive in length with said light source and a second refractor member shorter in length than said first member along said longitudinal axis whereby substantially all the luminous flux eminating from said light source directed toward said refractors passes through said first refractor plate member but only a portion of the luminous flux passing through said first refractor plate passes through said second refractor plate; and means for selectively positioning said second refractor plate along the light source longitudinal axis; said first refractor member having light incident and emergent surfaces and said light emergent surface having a plurality of spaced prisms extending parallel to the length of said linear light source; and, said second refractor member having light incident and emergent surfaces and said light incident surface having a plurality of spaced prisms extending perpendicular to said linear light source whereby the luminous flux passing through both said refractors is substantially glare-free and the luminous flux passing through only said first refractor is non-glare-free.

2. The system in accordance with claim 1 wherein said second member underlies said first member.

3. The system in accordance with claim 1 wherein said second member is approximately one-half the length of said first member.

4. The system in accordance with claim 1 wherein said housing has an open top end opposite said open bottom end and further comprising an open louver baffle closing said open top end.

5. A system in accordance with claim 1 wherein said selectively positioning means comprises means for slidably mounting said second refractor member with respect to said first member permitting said second member to slide in a direction parallel to said first refractor member prisms.

* * * * *